US009153879B2

(12) United States Patent
Frimmersdorf et al.

(10) Patent No.: US 9,153,879 B2
(45) Date of Patent: Oct. 6, 2015

(54) ELECTRICAL TERMINAL WITH A LOCKING LANCE

(71) Applicant: DELPHI TECHNOLOGIES, INC., Troy, MI (US)

(72) Inventors: Gregor Frimmersdorf, Solingen (DE); Eduard Cvasa, Bochum (DE)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 14/261,542

(22) Filed: Apr. 25, 2014

(65) Prior Publication Data

US 2014/0322995 A1 Oct. 30, 2014

(30) Foreign Application Priority Data

Apr. 26, 2013 (EP) ..... 13165648

(51) Int. Cl.

| | |
|---|---|
| ***H01R 11/22*** | (2006.01) |
| ***H01R 4/28*** | (2006.01) |
| ***H01R 13/432*** | (2006.01) |
| ***H01R 13/642*** | (2006.01) |
| ***H01R 43/16*** | (2006.01) |
| *H01R 13/11* | (2006.01) |

(52) U.S. Cl.

CPC ..... *H01R 4/28* (2013.01); *H01R 13/432* (2013.01); *H01R 13/642* (2013.01); *H01R 43/16* (2013.01); *H01R 13/113* (2013.01); *H01R 2201/26* (2013.01); *Y10T 29/49204* (2015.01)

(58) Field of Classification Search

CPC .. H01R 13/187; H01R 13/111; H01R 13/113; H01R 4/183; H01R 8/185; H01R 13/4362

USPC ..... 439/752, 843, 851, 852, 877, 878

See application file for complete search history.

(56) References Cited

U.S. PATENT DOCUMENTS

| | | | | |
|---|---|---|---|---|
| 5,613,885 | A * | 3/1997 | Plate et al. | 439/843 |
| 5,643,018 | A | 7/1997 | Sakai | |
| 5,911,603 | A * | 6/1999 | Mansutti | 439/748 |
| 5,971,816 | A * | 10/1999 | Chaillot | 439/852 |
| 6,019,646 | A * | 2/2000 | Okamura et al. | 439/852 |
| 7,014,515 | B2 * | 3/2006 | Lutsch et al. | 439/843 |
| 7,278,891 | B2 * | 10/2007 | Cvasa et al. | 439/852 |
| 7,938,699 | B2 * | 5/2011 | Okano | 439/877 |
| 8,323,061 | B2 * | 12/2012 | Hori | 439/852 |
| 8,523,619 | B2 * | 9/2013 | Itou et al. | 439/852 |
| 8,827,756 | B2 * | 9/2014 | Mueller | 439/852 |
| 8,944,860 | B2 * | 2/2015 | Mulot et al. | 439/852 |

* cited by examiner

*Primary Examiner* — Thanh Tam Le
(74) *Attorney, Agent, or Firm* — Robert J. Myers

(57) ABSTRACT

An electrical terminal for automotive vehicle connectors comprising a cage extending in a terminal insertion direction between a front opening and a tail. A locking lance extends longitudinally substantially in the insertion direction above the top wall from a joint to a free end. The locking lance is astride an intermediate bar which extends substantially along the insertion direction from a front portion to a rear portion respectively linked to the front end and the rear end of the cage.

11 Claims, 2 Drawing Sheets

ELECTRICAL TERMINAL WITH A LOCKING LANCE

CROSS-REFERENCE TO RELATED APPLICATION

This application claims the benefit under 35 U.S.C. §119 (a) of European Patent Application EP 13165648.0, filed on 26 Apr. 2013, the entire disclosure of which is hereby incorporated by reference.

TECHNICAL FIELD OF THE INVENTION

The invention relates to electrical terminals, and more particularly to electrical terminals to be accommodated in connectors used for automotive vehicles.

BACKGROUND OF THE INVENTION

For electrical connections in automotive vehicles, it is common to use male and female terminals made of metal such as copper, mounted in connector housings made of insulating material, such as plastics.

These terminals are usually made of folded and stamped sheet(s) of metal and comprise a rear tail for attaching (e.g. by crimping and/or soldering) an electrical lead and a terminal body having a connecting portion.

In case of female terminals, the connecting portion is a receptacle (also called cage) for receiving and contacting a male terminal. In case of male terminals, it is a pin to be inserted in a cage of female terminal.

For the connector mounting, a terminal is inserted in a respective housing cavity in a direction which is opposite to the mating direction of a counter-connector with the connector. In other words when the connector is mated with a counter-connector, terminals tend to be pushed back in a direction which is opposite to the direction in which terminal are inserted in the cavity. Thus terminals have to be prevented from moving back. For this purpose, locking lances are often used in order to lock terminals in insulating housings. This corresponds to the so called "primary locking", which is essentially useful during the assembly process of cable harnesses with connectors.

Sometimes, locking lances are made of plastic beams extending from the housing and engaging a respective opening in the terminal. Other times, locking lances are metal beams extending from the terminal.

Due to the continuous trend to enlarged functional contents in vehicles, downsizing of components in general, and of connectors in particular, becomes more important. Common terminal size has been set up to now to 0.63 mm for the width of the male terminal pins. To achieve smaller packaging in combination with reduced cable dimensioning, this dimension tends to become 0.5 mm, in order to reduce the terminal pitch in connectors from 2.54 mm to 1.8 mm. And this trend may lead to even smaller pitch and terminal dimensions.

Such terminals are called miniaturized terminals. For example, miniaturized female terminals have a cage adapted for receiving male pins having a cross-section less than 1 mm width, for instance 0.5 mm width or even less than that, and 0.4 mm thick or less. These so-called miniaturized terminals are made of only one piece but are required to fulfill common specifications based on usual performance of two piece terminals, in particular in terms of processing, of robustness, as well as in terms of retention force, dynamic load performance, reduced mating force, and increased lifetime.

Due to the small dimensions of miniaturized terminals, designing robust, though elastic, metal locking lances becomes challenging.

Metal locking lances extend longitudinally substantially between a front portion linked to the terminal body to a free end. In fact, when the terminal is accommodated in a housing cavity, the longitudinal direction of the locking lance makes an angle with the longitudinal direction of the terminal, so that the free end of the locking lance protrudes from the remaining part of the terminal. Indeed, the locking lance is elastically linked to the terminal body so as to retract along this terminal body during the insertion of the terminal in its housing cavity and to spring back for engaging a stop in the housing when in place in this cavity.

A coding ridge is also provided on the terminal body. Such a coding ridge prevents the insertion of the terminal in its cavity in a wrong orientation. The locking lance and the coding ridge are advantageously cut out from the same blank. The locking lance may advantageously be carried out by terminal body, in alignment with the coding ridge so as to have the locking lance protected by the coding ridge during the insertion of the terminal in its cavity.

Patent document EP 2193577 B1 discloses a female terminal of the prior art comprising a terminal body made of a folded and stamped sheet of metal. In female terminals, the terminal body has a cage-shaped receptacle which extends in the insertion direction of the male terminal pin. The terminal body extends longitudinally along this insertion direction between a front end and a rear end. The front end comprises a front opening, for inserting the male terminal pin, and the rear end is linked to the rear tail through an intermediate portion. A locking lance extends longitudinally along the insertion direction from a front portion to a free end. The front portion is elastically linked to the terminal body, toward (i.e. in the vicinity of) its front end. The free end of the locking lance is toward the rear end of the terminal body. The locking lance is in alignment with a coding ridge. The locking lance has essentially an L-shape cross section with a side wall and a top wall, folded at right angle from each other.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

An aim of the invention consists in improving the design of locking lances of miniaturized terminals, in particular with regard to the retention of terminal in their respective cavities.

This aim is at least partially achieved with a terminal for automotive vehicle connectors, wherein the locking lance is astride an intermediate bar which extends substantially along the insertion direction from the front portion of the locking lance to a rear portion linked to the rear end of the terminal body.

With such an intermediate bar, extending between both ends of the terminal body, the pull out force is distributed both in the front and rear parts of the terminal body. The retention force of the terminal in its cavity is consequently better distributed in the terminal body (for instance, the targeted retention force, or pull out force, is at least 30N).

According to another aspect, the invention relates to an electrical connector comprising at least one terminal and a housing made of insulating material, the housing having at least one cavity for receiving the at least one terminal, the locking lance of which having a free end engaging a stop of the housing.

According to a further aspect, the invention relates to a manufacturing process for making electrical terminals, comprising steps of stamping and folding a sheet of metal for making a terminal body, a coding ridge, and a locking lance extending longitudinally from the coding ridge to a free end, and characterized in that the sheet of metal is folded at least four times with an angle orientated in the same direction so as to fit an intermediate bar at least partially in the coding ridge.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

In the figures, the same references denote identical or similar elements.

In this document, for the sake of simplification and clarity, the invention is illustrated with a female terminal, but it is obvious that the invention can be applied to male terminals and consequently, it is contemplated to protect both male and female terminals.

In female terminals, the terminal body is a cage which extends in the insertion direction of the male terminal pin, between a front opening, for inserting the male terminal pin, and the rear tail.

Figure 1:
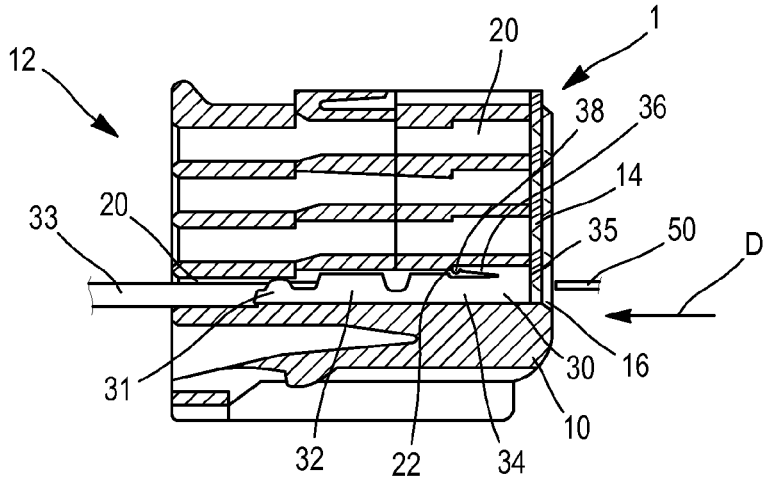
FIG. 1 is a cross section view of a connector in accordance with one embodiment.

FIG. 1 shows an electrical connector 1 according to an embodiment of the invention. The electrical connector 1 comprises a housing 10 made of insulating material such as plastics, e.g. polybutylene terephthalate (PBT), polyamide 66 (PA 66), etc. This housing has a plurality of cavities 20 for accommodating electrical female terminals 30. In FIG. 1, only one miniaturized terminal 30 is represented in cavities 20. This terminal has a rear tail 31. In the represented embodiment, the rear tail 31 has a crimping section 32 for attaching an electrical lead 33. The terminal 30 also comprises a terminal body. As the illustrated terminal is a female terminal the terminal body is a box-shaped cage 34 for receiving a male terminal pin 50 (only the mating part of this male terminal is represented in FIG. 1).

The cage 34 (i.e. the terminal body) extends in the insertion direction D defined by the direction of mating or insertion of the male terminal pin 50 in the cage 34. Consequently, the cage 34 extends between a front end, here an opening 35 within which the male terminal pin 50 is inserted, and a rear end connected to the rear tail 31. The cage 34 is adapted for receiving a male pin having a cross-section about 0.5 mm width or less. For example, the external dimensions of the cage are 1 mm width (from a lateral wall to the other) and 1.15 mm height (from the top wall to the bottom wall). If the sheet metal is 0.15 mm thick, the internal dimensions are about 0.7 mm width and 0.85 mm height. These are average values as the female terminals are manufactured within specified tolerance ranges.

For the connector mounting, a female terminal 30 is inserted in a respective housing cavity 20, from the back side 12 of the housing 10. It is inserted in a direction which is opposite to the male terminal insertion direction D. The female terminal is accommodated and blocked in the frontward direction (i.e. towards the connector face which is intended to be mated with a counter-connector accommodating the male terminals) in its cavity 20 by a front wall 14 having openings 16 for inserting male terminal pins 50. In order to prevent the female terminal 30 from moving back and being withdrawn from its cavity 20, a locking lance 36 engages a stop 22.

The locking lance 36 has at least a lateral wall 37 and a top wall 137 and is elastically connected to a coding ridge 40.

The coding ridge has a front part 41 and a rear part 42. The front part 41 is connected to the cage 34 in the vicinity of its front end (i.e. toward the opening 35). The rear part 42 is connected to the cage 34 in the vicinity of its rear end (i.e. toward the rear tail 31).

The locking lance 36 extends longitudinally substantially in the insertion direction D from a joint 39 connected to the front part 41 of the coding ridge 40, to a free end 38. It does not mean that the locking lance 36 is parallel to the insertion direction D. Indeed, when the female terminal 30 is accommodated in its cavity 20, the longitudinal direction of the locking lance 36 makes an angle (for instance between 3 and 10 degrees, and advantageously about 6.5 degrees) with the longitudinal direction of the cage 34. In other words, the locking lance 36 makes an angle with the coding ridge 40 at the joint 39. Then, the free end 38 of the locking lance 36 protrudes from the remaining part of the female terminal 30. That is to say, the free end 38 projects from the top wall of the coding ridge 40, and consequently from the upper surface of the cage 34. Indeed, the locking lance 36 is elastically linked to the coding ridge 40. It can retract along the cage 34, so as to be substantially flush with the top wall 143 of the coding ridge 40, during the insertion of the female terminal 30 in its cavity 20. After insertion, when the female terminal 30 is in place in its cavity 20, the locking lance springs back for engaging the housing 10 and more particularly the stop 22.

The locking lance is astride an intermediate bar 60 which extends substantially along the insertion direction D from the front portion 61 to a rear portion 62. Thanks to this configuration, the deflection of the locking lance 36 is limited by the intermediate bar 60.

The intermediate bar 60 extends through the front 41 and rear 42 parts of the coding ridge 40. Then, the front 41 and rear 42 parts of the coding ridge 40 are made of a metal sheet folded in threefold thickness. In other words, the front 41 and rear 42 parts of the coding ridge 40 comprise three layers of the blank from which the terminal is made. That is to say that the two lateral walls 43 of the coding ridge 40 sandwiches respectively the front portion 61 and the rear portion 62 of the intermediate bar 60, i.e. the intermediate bar 60 essentially fills in the front portion 61 and the rear portion 62 of the U-shape coding ridge 40 (see also FIG. 5).

It means that during the manufacturing process of the terminal 30, the blank 100 is folded and/or rolled up several times in the same direction so as to fit the intermediate bar 60 in the front 41 and the rear 42 parts of the coding ridge 40. "Rolled up" does not mean that the front 41 and the rear 42 parts of the coding ridge 40 have a round cross section. It rather means that the cross-section has a G-shape which can be flattened.

Figure 6:
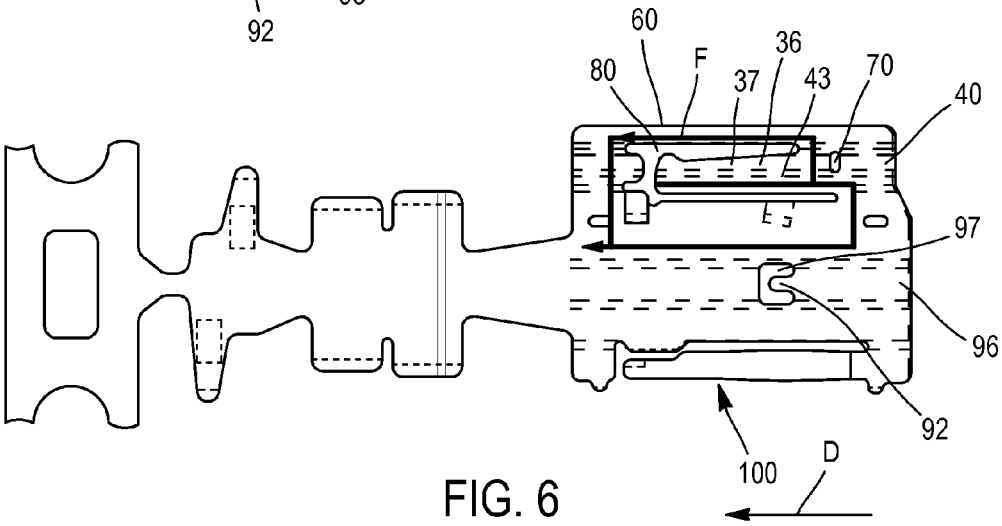
FIG. 6 is a top view of the unfolded blank from which the terminal of FIGS. 2-5 is formed in accordance with one embodiment.

As shown in FIG. 6, from the free end 38 of the locking lance 36 to the joint 39, the locking lance 36 is first linked to the intermediate bar 60 and second to the terminal cage 34. In other words, the slot 80 resulting from the cut out of the locking lance 36 in the blank 100, is shorter on the side of the intermediate bar 60 than on the side of the lateral wall of the cage 34 the coding ridge is attached to.

Figure 2:
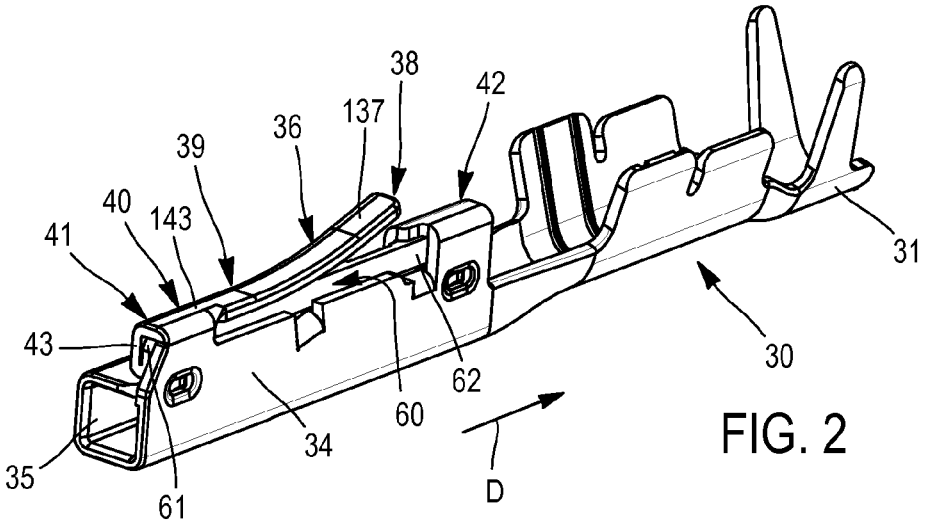
FIG. 2 is a perspective view of a terminal in accordance with one embodiment.
Figure 3:
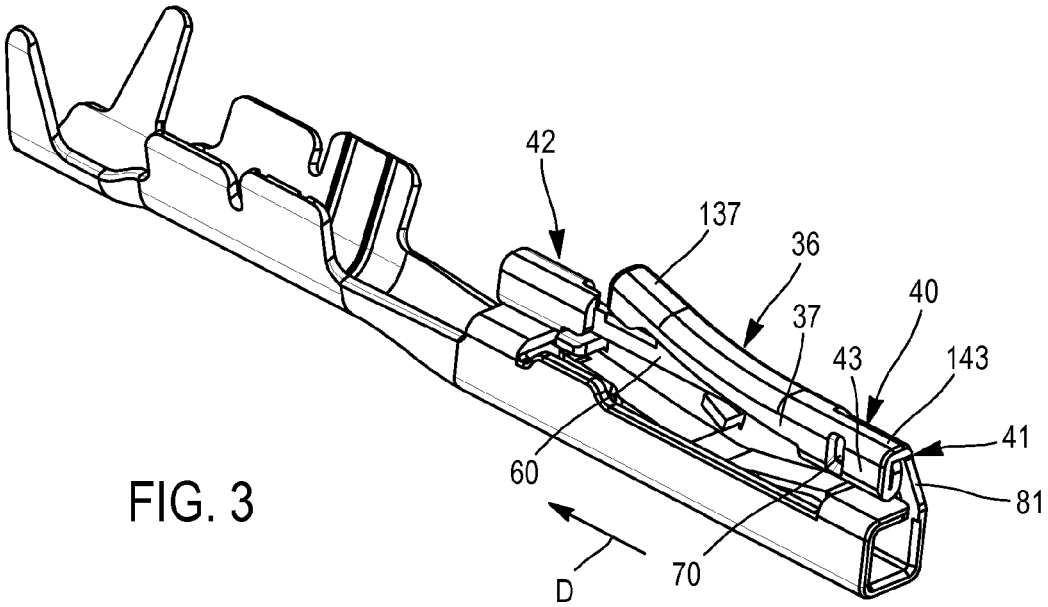
FIG. 3 is a different perspective view of the terminal of FIG. 2 in accordance with one embodiment.

Further, the lateral wall 37 comprises an opening 70 or slot located in front of the locking lance 36 with regard to the insertion direction D, i.e. in the area where the locking lance 36 is connected to the coding ridge 40 and consequently to the intermediate bar 60 too. In particular, the top wall 137 of the locking lance 36 is connected to the two lateral walls 43 of the coding ridge 40. But the lateral wall 37 of the locking lance 36 is connected to the coding ridge 40 through an intermediate bar 60 (see FIGS. 2 and 3). Indeed, the lateral wall 37 of the locking lance 36 is separated from the lateral wall 37 of the coding ridge 40 by the opening 70.

As a consequence, as shown with the arrow F, the connection area between the locking lance 36 and the coding ridge 40 transmits the reaction force to a pull out force applied on the electrical lead 33, from the locking lance 36 to the top wall 143 of the coding ridge 40 and to the intermediate bar 60. Since the intermediate bar 60 is extended up to a rear portion of the cage 34, the reaction force is also transmitted to the rear tail 31 connected to the electrical lead 33 on which the pull out force has been loaded.

Further, in case of deflection of the locking lance 36, e.g. while the terminal 30 is inserted in a cavity 20, in addition to the locking lance deformation, the intermediate bar 60 can carry partially the deformation and therefore the stress as well. This functionality is made possible by the opening (slot) 70 cut out in the locking lance lateral wall 37, in the connection area between the locking lance 36 and the coding ridge 40, bypassing the stiffness of the connection between the locking lance 36 and the side wall of the cage 34.

Thanks to this functionality, the locking lance 36 can be relatively flexible while kept short.

The terminal 30 also comprises a slanted edge 81 between the front end or opening 35 of the cage 34 and the front part 41 of the coding ridge 40. This feature is allowed because the locking lance 36 can be relatively short as explained above. Then it is possible over the cage length to align the front 61 and rear 62 portions of the coding ridge 40, the locking lance 36 and the slanted edge 81.

The slanted edge 81 provides for a smoother interface and prevents tearing sealing joint when inserting the terminal 30 in the connector. This allows keeping the sealing integrity even after several reworks.

Figure 4:
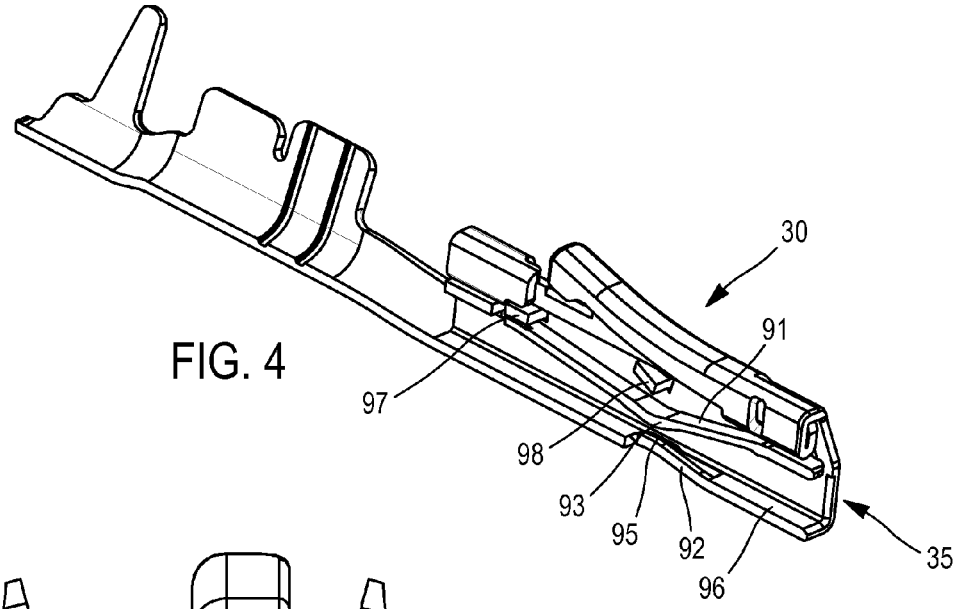
FIG. 4 is a longitudinal cross section view of the terminal of FIGS. 2 and 3 in accordance with one embodiment.
Figure 5:
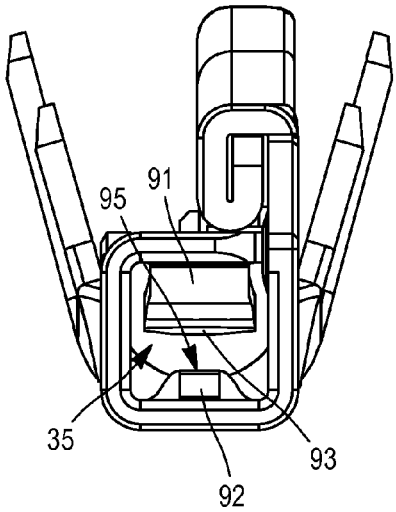
FIG. 5 is a an end view of the terminal of FIGS. 2-4 in the insertion direction of the terminal in accordance with one embodiment.

As shown in FIGS. 4 and 5, the terminal 30 comprises an upper 91 and a lower 92 contact beams.

The upper contact beam 91 is stamped and coined so as to provide a more steady behavior in response to stress all over its length. To this aim, the thickness of the upper contact beam 91 is reduced upstream and downstream of the upper contact area 93, where the stress is lower.

The upper contact beam 91 extends from a front end connected to the cage 34 toward its front opening 35, to a free end. The movement of this free end is limited by a support tongue 97, located toward the rear end of the cage 34, which extends in a transverse direction below the intermediate bar 60.

A blocking tongue 98, also extending in a transverse direction below the intermediate bar 60, faces the upper contact area 93 and limits the movement of the upper contact beam 91 toward the intermediate bar 60.

A lower contact beam 92 is cut out in the bottom face 96 of the cage 34, with a cutout 97 having a U-shape (see also FIG. 6). Indeed, the lower contact beam 92 is cut in the bottom face out along three of its sides before being embossed so as to limit the stress in the lower contact area 95. This way even if the terminal 30 is plated with one or several layer(s) of non-ductile material, such as nickel, cracks in this material can be limited or avoided. Such a feature allows improving the quality of the electrical contact and reduced the electrical contact resistance.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. A terminal for automotive vehicle connectors, comprising:

a terminal body made of a folded and stamped sheet of metal, the terminal body extending longitudinally along an insertion direction between a front end and a rear end, defining a locking lance characterized as a cantilever beam extending longitudinally along the insertion direction from a fixed end connected to the terminal body in a vicinity of the front end to a free end in the vicinity of the rear end, wherein the locking lance is astride an intermediate bar which extends substantially along the insertion direction from a front portion to a rear portion respectively linked to the front end and the rear end of the terminal body, wherein the terminal body comprises a coding ridge made of a metal sheet folded in threefold thickness.

2. The terminal according to claim 1, wherein the coding ridge has a front part with a top wall and two lateral walls, the two lateral walls sandwiching the front portion of the intermediate bar, at least one of the two lateral walls comprising an opening located in front of the locking lance with regard to the insertion direction.

3. The terminal according to claim 1, wherein the coding ridge has a rear part with a top wall and two lateral walls, the two lateral walls sandwiching the rear portion of the intermediate bar.

4. The terminal according to claim 2, comprising a slanted edge between the front end of the terminal body and the front part of the coding ridge.

5. The terminal according to claim 1, comprising an upper contact beam extending along the insertion direction from the front end of the terminal body to the free end and comprising an upper contact area, the terminal further comprising a support tongue, located toward the rear end of a cage, which extends in a transverse direction below the intermediate bar, for supporting the free end of the upper contact beam.

6. The terminal according to claim 5, comprising a blocking tongue facing the upper contact area and blocking movement of the upper contact beam towards the intermediate bar.

7. The terminal according to claim 1, wherein deflection of the locking lance is limited by the intermediate bar.

8. The terminal according to claim 1, wherein the locking lance is first linked to the intermediate bar and second to the terminal body from the free end of the locking lance to the fixed end flexibly connecting the locking lance to the front end of the terminal body.

9. The terminal according to claim 1, comprising a lower contact beam cut out in a bottom face of the terminal body, with a cutout having a U-shape.

10. An electrical connector, comprising:

at least one terminal including a terminal body made of a folded and stamped sheet of metal, the terminal body extending longitudinally along an insertion direction between a front end and a rear end, defining a locking lance characterized as a cantilever beam extending longitudinally along the insertion direction from a fixed end connected to the terminal body in a vicinity of the front end to a free end in the vicinity of the rear end, wherein the locking lance is astride an intermediate bar which extends substantially along the insertion direction from a front portion to a rear portion respectively linked to the front end and the rear end of the terminal body, wherein the terminal body comprises a coding ridge made of a metal sheet folded in threefold thickness; and a housing made of an insulating material, the housing having at least one cavity for receiving the at least one terminal, the locking lance of which having the free end engaging a stop within the housing.

11. A manufacturing process for making electrical terminals, comprising the steps of:

stamping a sheet of metal for making a terminal body a coding ridge, and a locking lance extending longitudinally from the coding ridge to a free end;

forming the coding ridge by folding the stamped metal sheet in threefold thickness; and rolling and folding the sheet of metal so as to fit an intermediate bar at least partially in the coding ridge.

* * * * *